United States Patent [19]

DeGaeta

[11] 4,216,629

[45] Aug. 12, 1980

[54] METHOD AND APPARATUS FOR PRODUCING BALLS

[76] Inventor: Albert M. DeGaeta, 10 Patriot Dr., Gladstone, N.J.

[21] Appl. No.: 942,632

[22] Filed: Sep. 15, 1978

[51] Int. Cl.[2] ..... B24B 11/02

[52] U.S. Cl. ..... 51/125; 51/131.2; 51/289 S; 51/5 D

[58] Field of Search ..... 51/5 D, 125, 129, 130, 51/131.2, 289 S, 109 R; 125/8

[56] References Cited

U.S. PATENT DOCUMENTS

| | | | |
|---|---|---|---|
| 1,805,269 | 5/1931 | Van Sickel | 125/8 |
| 2,345,177 | 3/1944 | Briney | 51/131.2 X |
| 2,708,331 | 5/1955 | Schmaltz | 51/266 X |
| 2,912,799 | 11/1959 | Boettcher | 51/131.2 |
| 3,104,502 | 9/1963 | Burch | 51/289 S X |
| 3,374,582 | 3/1968 | Boettcher | 51/131.2 |
| 3,377,750 | 4/1968 | Day | 51/131.2 |
| 3,457,682 | 7/1969 | Boettcher et al. | 51/129 |
| 4,043,081 | 8/1977 | DeTroy | 51/129 |

*Primary Examiner*—Gary L. Smith
*Assistant Examiner*—Robert P. Olszewski
*Attorney, Agent, or Firm*—Robert E. Burns; Emmanuel J. Lobato; Bruce L. Adams

[57] ABSTRACT

Cylindrical or cubical blanks for producing balls, in particular small balls for ball bearings and placed in a vertical tube positioned eccentrically above a grinding disc having a horizontal plane abrasive upper surface which forms the bottom of the tube. The blanks partially fill the tube to a depth many times the cross section dimension of the blanks. For example many thousand of the blanks may be put in the tube at one time. The disc is then rotated to grind and tumble the blanks in the tube and to produce circulation of the blanks in the tube continually to bring different blanks into contact with the abrasive upper surface of the disc. During the grinding operation, a nozzle directs grinding fluid into the tube so as to promote circulation of the blanks in the tube and to inhibit the sticking of blanks to the side walls of the tube. In this manner all of the blanks in the tube are ground to approximately spherical shape. Means is preferably provided for moving the disc and tube toward one another to compensate for wear of the disc and to maintain the sphere relationship between the lower end of the tube and the disc face. If the abrasive of the disc has a hardness lower than the hardness of diamond, means is preferably provided for dressing the upper surface of the disc in order to keep it plane and free of grooves.

22 Claims, 5 Drawing Figures

METHOD AND APPARATUS FOR PRODUCING BALLS

FIELD OF INVENTION

The present invention relates to method and apparatus for producing generally spherical balls from non-spherical blanks for example for making bearing balls and in particular very small bearing balls and further to rapidly reducing the diameter of spherical balls.

BACKGROUND OF THE INVENTION

In the conventional method of making bearing balls, cylindrical slugs are cut from steel wire of proper size for the desired size of the finished balls. These cylindrical slugs are then "flashed" or rounded with the slugs in a soft "as cut" condition. The rounding process comprises rolling the slugs between an upper plate and a lower plate which are rotated relative to one another at low speed for example 80 rpm so as plastically to deform the slugs into approximately spherical shape. Because of the wide variation in slug shape this process can exert excessive stress on individual pieces so as to cause internal cracks in the metal slugs. If a load of 100,000 to 200,000 balls is being processed, it will be possible to have 1 to 5% of the balls with cracks. As there is no simple method of separating the cracked spheres, a percentage of the finished bearing balls will be defective. The flashed slugs are then heat-treated to harden them whereupon they are ground and lapped to form the finished bearing balls. It will be understood that this flashing process cannot be used on frangible material since such material will crack.

SUMMARY OF THE INVENTION

It is an object of the present invention to provide an improved process and improved apparatus for producing generally spherical balls from non-spherical blanks for example blanks that are cylindrical or cubical. In accordance with the invention a large number of blanks, for example many thousands, are placed in a generally vertical tube which is positioned eccentrically above a grinding disc having a generally horizontal plate abrasive upper surface which forms the bottom of the tube. The blanks partially fill the tube to a depth many times the cross sectional diameter of the blanks. The disc is then rotated at a selected speed to grind and tumble the blanks in the tube and to produce circulation of the blanks in the tube so as continually to bring different blanks into contact with the abrasive upper surface of the grinding disc. Concurrently, grinding fluid is delivered into the tube to promote circulation of the blanks in the tube to inhibit the sticking of blanks to the side walls of the tube. The grinding operation is continued until the blanks are ground into approximately spherical shape of the desired size. The balls thus produced are then lapped to form the finished bearing balls. As the process in accordance with the present invention makes it possible to produce substantially spherical balls which are very close to the desired finished size, the conventional grinding operation is eliminated and only lapping operations are required.

When the blanks are made of material that can be hardened, for example when they are cut from steel wire, the blanks are hardened before being round to approximately spherical shape by the process of the present invention. Since the process is thus performed on hard blanks, it is likewise applicable to hard frangible material such as cubes or cylinders of glass, ruby, silicon nitride, etc.

To increase the capacity of the apparatus, a plurality of tubes are preferably arranged around the axis of the rotating disc so that blanks in all of the tubes are processed at the same time. Means is preferably provided for varying the speed of rotation of the disc so that different speeds can be used for different materials or sizes of blanks and at different stages in the grinding operation. For example the speed of rotation of the disc may be reduced near the end of the grinding operation.

Means is also preferably provided for raising the grinding disc or for lowering the tube or tubes containing the blanks in order to compensate for wear of the disc and to maintain the same gap between the disc and the lower end of the tube. If the abrasive of the disc has a hardness lower than the hardness of diamond, means is preferably provided for continuously or intermittently dressing the upper surface of the disc so as to keep it plane and free of grooves or other non-uniformities.

BRIEF DESCRIPTION OF DRAWINGS

The nature, objects and advantages of the method and apparatus in accordance with the present invention will be more fully understood from the following description in conjunction with the accompanying drawings which show by way of example preferred embodiments of the apparatus. In the drawings.

DESCRIPTION OF PREFERRED EMBODIMENTS

Figure 1:
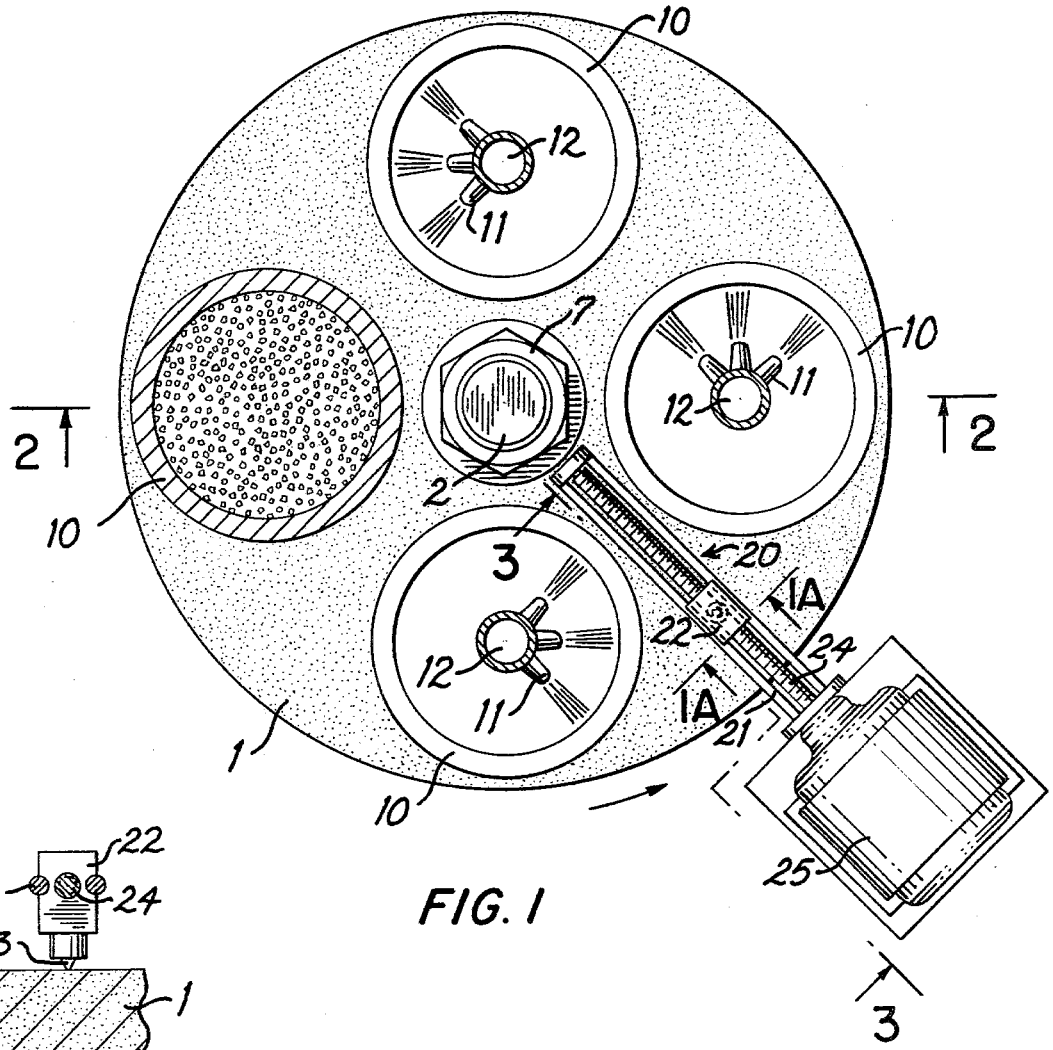
FIG. 1 is a plan view shown partially in section of apparatus for carrying out the process of the present invention.
Figure 3:
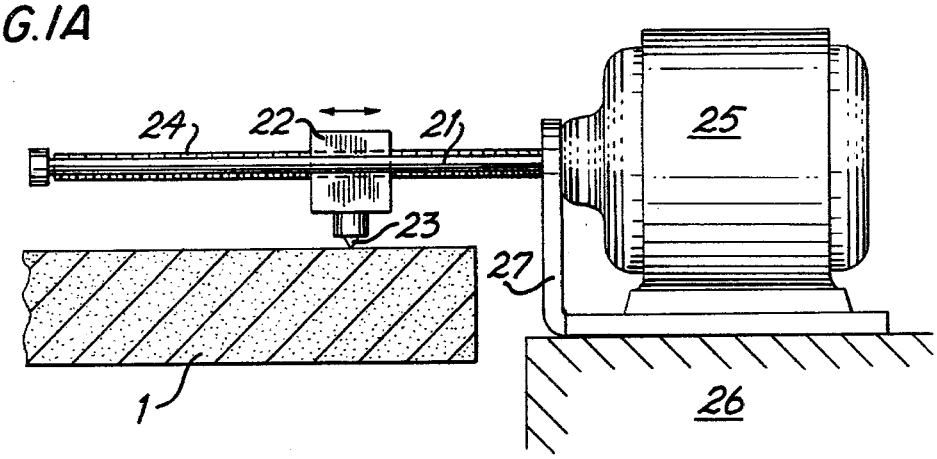
FIG. 3 is a partial vertical section taken approximately on the line 3—3 in FIG. 1.
Figure 2:
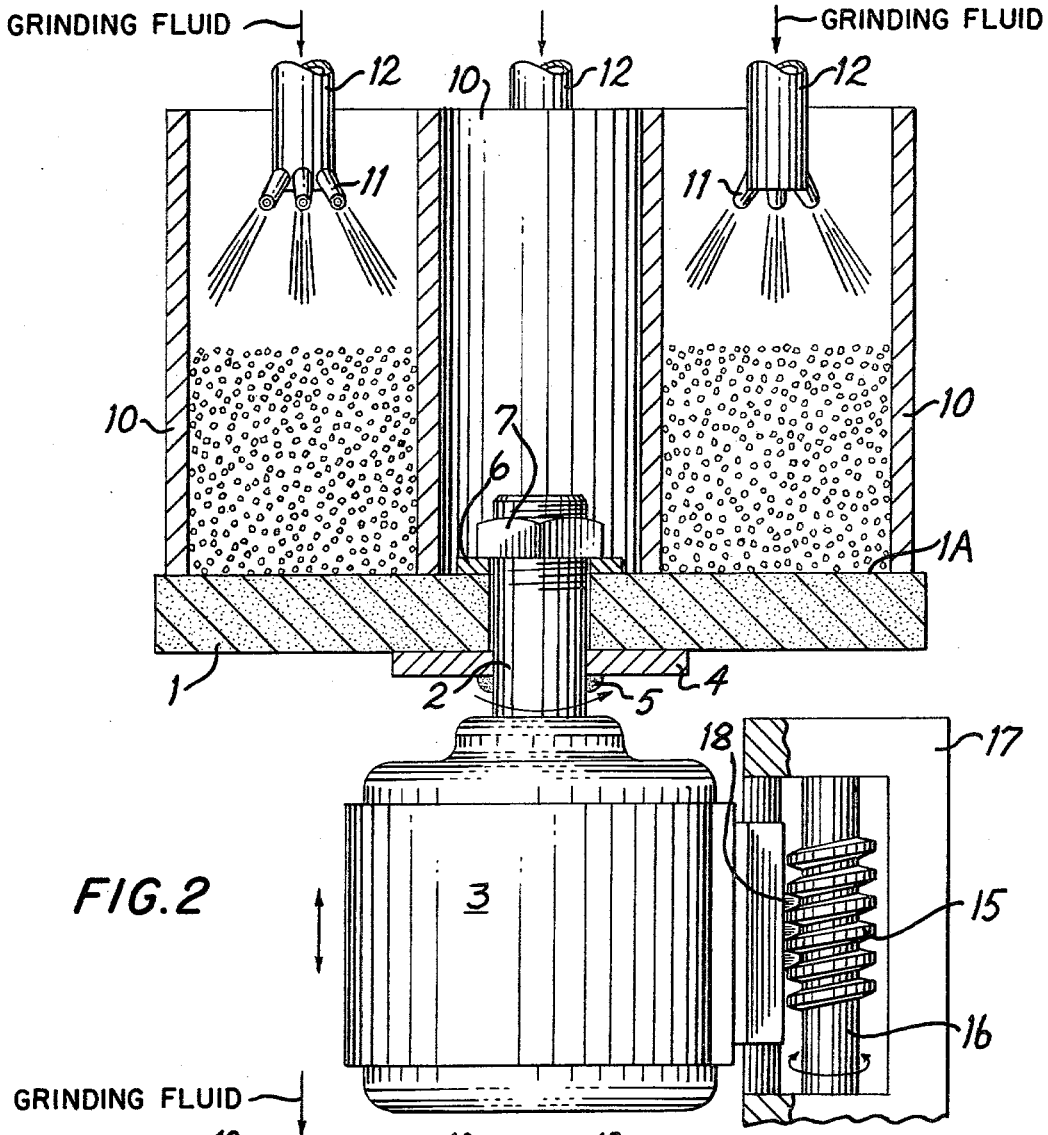
FIG. 2 is a vertical section taken approximately on line 2—2 in FIG. 1.

Apparatus in accordance with the invention as shown by way of example in FIGS. 1–3 comprises a grinding disc 1 mounted on the shaft 2 of a variable speed electric motor 3. The grinding wheel is shown as being supported by a washer 4 which seats against a shoulder 5 on the motor shaft 2 and is held firmly in place by a second washer 6 and nut 7 which is screwed onto the outer threaded end of the motor shaft. With the grinding disc mounted in this manner, it can readily be removed for replacement as it becomes worn.

The grinding disc 1 is formed of or surfaced with abrasive material for example aluminum oxide or silicon carbide. Alternatively the upper surface of the grinding disc may be plated or coated with natural or synthetic diamond powder or Borazon. The upper surface of the grinding disc is plane and at least approximately horizontal. One or more open-ended tubes 10 are mounted eccentrically above the grinding disc 1, four such tubes being shown by way of example in FIG. 1. Each of the tubes is at least approximately vertical and is positioned so that the upper surface 1A of the grinding disc 1 forms the bottom of the tube. Suitable means (not shown) is provided for supporting the tubes 10 in fixed position as shown. While the tubes 10 can be of different cross sectional shapes, for example square or trapezoidal, best results are presently attained with tubes of circular cross section as shown in FIG. 1. The tubes have a diameter which is less than the height of the tubes and somewhat less than the radius of the grinding disc 1 so that the tubes are accommodated between the periphery of the grinding disc and the shaft of the motor. As illustrated in FIG. 2, the tubes 10 receive the non-spherical blanks which are to be ground to approximately spherical shape. A large number of the blanks can be ground at one time. For example 80,000 to 200,000 blanks can be put in each of the tubes so as to fill each tube to a depth which is many times the cross sectional dimension of the blanks. As illustrated by way of example in FIG. 2, the tubes 10 are about half full. However, if desired, a smaller number of blanks can be ground. It is not necessary to use all of the tubes.

As the grinding disc 1 is rotated by the motor 3 at selected speed, for example 1725 rpm, the blanks which are in engagement with the disc are ground and tumbled and are carried toward the down-stream side wall of the tube, i.e. the side towards which the disc rotates, sot as to crowd other blanks upwardly along the wall of the tube. This produces a circulation of the blanks in the tube so that different blanks are successively brought into engagement with the grinding disc 10 and thereby subjected to a grinding operation.

During the grinding operation, a fluid, for example cutting oil, may be delivered to the mass of blanks in the tube, for example by nozzles 11 at the lower end of a supply conduit 12. The nozzles 11 are located above the mass of blanks in the tube and are preferably directed primarily toward the down-stream side wall of the tube. Fluid is delivered to the conduit 12 at a selected rate, for example by a variable capacity pump (not shown). The fluid is directed onto the inner walls of the tube to serve as a grinding fluid and to promote circulation of the blanks or slugs in the tube and to keep them from sticking to the side wall of the tube. When the density of the balls is light, as with balls of silicon nitride (3.1 gravity) and when a small quantity of blanks are to be processed, grinding fluid need not be used. The process can be carried out completely dry. If desired, air can be delivered through the nozzles to promote circulation of the blanks.

As the balls to be produced may be very small for example 0.05" diameter, the lower ends of the tube 10 must be very close to the upper surface 1A of the grinding disc 1 and may lightly engage the disc. In order to compensate for any wear on the lower ends of the tubes 10 or disc face 1A, provision is preferably made for lowering the tubes or for raising the disc. As shown by way of example in FIG. 2, means is provided for raising the motor 3 and thereby raising the disc 1 which is mounted on the shaft 2 of the motor. Such means is illustrated as comprising a screw thread 15 on a shaft 16 rotatably supported by a frame 17 and driven by a reversible motor (not shown). The motor 3 is mounted for vertical movement on one side of the frame 17 and is provided with a follower 18 which engages the screw 15. Thus by rotation of the screw 15 in one direction or the other, the motor 3 can be raised or lowered.

Figure 1A:
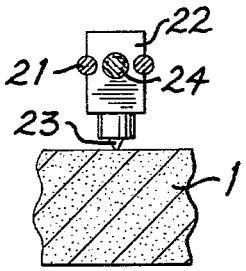
FIG. 1A is a fragmentary cross section taken approximately on the line 1A—1A in FIG. 1.

If the abrasive of the grinding disc 1 has a hardness lower than that of diamond or Borazon, means is preferably provided for dressing the upper surface of the grinding disc 1 so as to keep it plane and free of grooves or other non-uniformities. In FIGS. 1, 1A and 3, dressing means 20 is shown by way of example as comprising a track 21 which is located above the grinding disc 1 and extends horizontally and approximately radially of the disc between two of the tubes 10. A carriage 22 which is movably along the track 21 carries a dressing tool 23 which may for example be a diamond. Means for moving the carriage 22 along the track 21 is shown as comprising a feed screw 24 driven by a variable speed reversible motor 25 mounted on a suitable base 26 which also supports a frame 27 that supports the track 21. While the grinding disc 1 is rotated by the motor 3, the carriage 22 of the dressing tool 23 is moved along the track 21 by rotation of the screw 24 so as to cause the dressing tool 23 to traverse and thereby dress the upper surface of the grinding disc 1. The motor 25 is operable continuously or intermittently at selected intervals and speed to effect a dressing of the grinding wheel as desired. Moreover, as the grinding wheel is dressed down, it is raised by means of the screw 15 to compensate for the material removed by the dressing operation.

Figure 4:
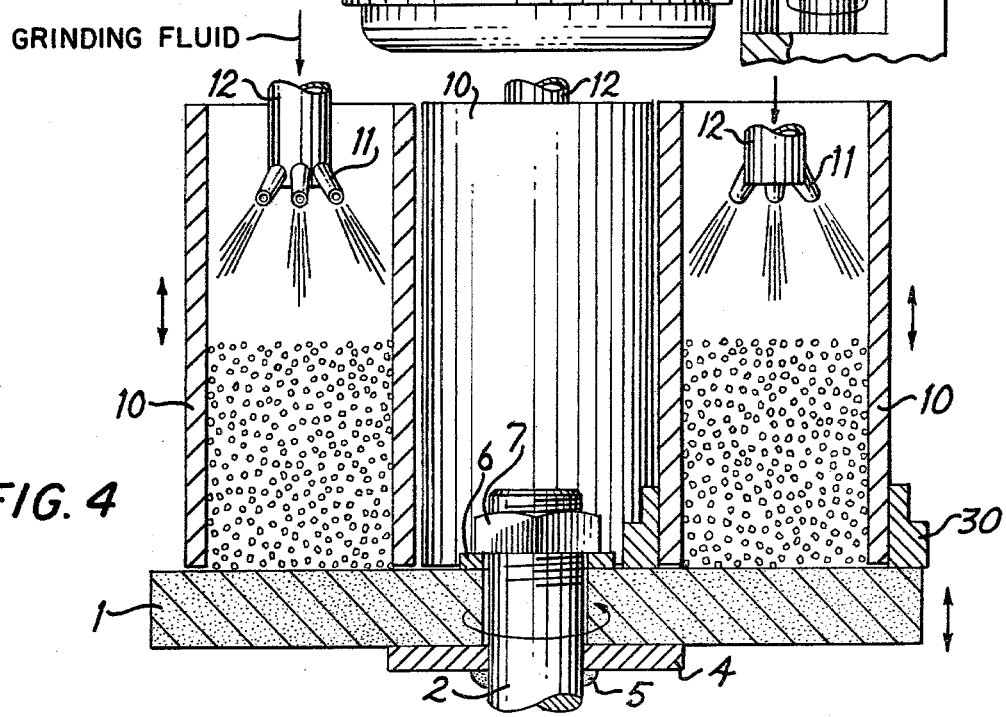
FIG. 4 is a partial vertical section corresponding to a portion of FIG. 2 but illustrating a modification.

An alternative means for dressing the grinding wheel 1 is shown by way of example in FIG. 4 as comprising a ring 30 which surrounds the lower end of one of the tubes 10 containing the blanks being processed. The ring 30 is formed of or surfaced with an abrasive material that is harder than the abrasive of the grinding disc 1. The lower surface of the dressing ring 30 is flush with or slightly below the lower end of the tube 10. While the grinding disc 1 is rotating it is raised slightly, for example by the arrangement shown in FIG. 2, so that the upper surface of the grinding disc is pressed against the dressing ring 30 and is thereby dressed so as to maintain a plain surface free of grooves or other non-uniformities. It will be understood that instead of the dressing ring being a separate ring as illustrated in FIG. 4, it may be the lower end of the tube 10 itself in which diamond powder or other ultrahard abrasive material is embedded. Except for the different means for dressing the grinding disc, the apparatus of FIG. 4 is the same as that illustrated in FIGS. 1–3 and described above.

PROCESS

The process of the present invention comprises forming a multiplicity of non-spherical blanks of the material of which generally spherical balls are to be produced. The blanks may for example be formed by cutting cylindrical slugs from steel wire with selected length-to-diameter ratio for the desired finished size ball. For example the length of the slugs may be approximately equal to the diameter of the wire. The slugs after cutting are preferably hardened to a hardness greater than a 40 Rockwell "C". These hardened slugs are then placed in the vertical tubes 10 of the apparatus illustrated in the drawings and described above. As the disc rotates the slugs circulate in the tubes and become shaped to approximately spherical form. A coolant is sprayed onto the inner walls of the tube to serve as a grinding fluid and to prevent the slugs from sticking to the inside of the tube. The grinding operation is continued until the slugs are ground to approximately spherical form and are of a size slightly larger than the desired size of the finished balls. The generally spherical balls are then removed from the apparatus and finished by suitable lapping operations.

The process in accordance with the present invention is also applicable to cubes or cylinders of glass, ruby, silicon nitride, and other materials which by reason of being frangible could not be shaped by the "flashing"

operation heretofore applied to soft metal slugs. The speed at which the grinding disc 1 of the apparatus is rotated is selected according to the size and material of the blanks. For example an 8" diameter grinding wheel may be operated at a speed of 1725 rpm.

The process in accordance with the present invention will permit rapid removal of stock from a large number of balls in a relatively short period of time. For example with 80,000 balls of 440 C material hardened to 60 R.C in a 3.5" I.D. tube on a 8" diameter wheel operating at 1725 rpm a reduction of 0.0005" diameter reduction in 0.057" diameter balls was achieved in approximately 65 minutes. The pressure applied to the balls during grinding is the weight of the balls above. In this example the balls filled the tube to a depth of about 3". The number of balls or pieces placed in the vertical tube is governed by the ability of the parts to circulate and the accuracy of the sphericity desired of the finished balls.

While a preferred embodiment of the invention has been herein described, it will be understood that many modifications and variations may be made and that the invention is hence in no way limited to the described example.

What is claimed is:

1. Apparatus for producing generally spherical balls from non-spherical blanks which comprises a grinding disc having a generally horizontal plane abrasive upper surface, at least one generally vertical stationary tube positioned eccentrically above said disc with its lower end very close to but spaced slightly from the upper face of said disc to receive a multiplicity of said blanks partially filling said tube to a depth many times the cross sectional dimension of said blanks, the height of said tube being greater than its cross sectional dimension, means for rotating said disc at selected speed about a generally vertical axis to grind and tumble said blanks in said tube and to produce circulation of said blanks in said tube continually to bring different blanks and different surfaces of said blanks into contact with said abrasive surface of said disc whereby all of said blanks are ground to substantially spherical shape and reduced to the desired diameter.

2. Apparatus according to claim 1, comprising means for moving said disc and tube toward one another to compensate for wear of said disc or the lower end of said tube.

3. Apparatus according to claim 2, comprising means for dressing the upper face of said disc to keep it plane.

4. Apparatus according to claim 3, in which said dressing means comprises a track extending generally radially of said disc above the upper surface thereof, a carriage movable along said track, a dressing tool carried by said carriage in position to engage the upper face of said disc and means for moving said carriage along said track as said disc is rotated to dress the upper face of said disc by said dressing tool.

5. Apparatus according to claim 3, in which said dressing means comprises abrasive material on the lower end of said tube having a hardness greater than that of said abrasive surface of said disc, means being provided for bringing said disc into engagement with said abrasive material on the lower end of said tube to dress the upper face of said disc.

6. Apparatus according to claim 1, further comprising means for delivering fluid onto the inner wall of said tube during rotation of said disc to provide cooling and to promote circulation of said blanks in said tube and inhibit sticking of blanks to the side wall of said tube.

7. Apparatus according to claim 6, in which said means for delivering fluid comprises a nozzle located above the level of said blanks in said tube and positioned to direct said fluid on the inner wall of said tube.

8. Apparatus according to claim 7, in which said nozzle directs said fluid primarily on the inner wall of said tube at the side of the tube toward the inner wall of which said disc rotates.

9. Apparatus according to claim 1, comprising means for varying the speed at which said disc is rotated.

10. Apparatus according to claim 1, in which said tube is of generally circular cross section.

11. Apparatus according to claim 1, comprising a plurality of said tubes arranged around the axis of said disc.

12. Apparatus according to claim 1, comprising means for moving said disc and tubes toward one another, one of said tubes having at its lower edge abrasive material having a hardness greater than that of said abrasive surface of said disc for dressing said upper surface of said disc as said disc is rotated and said disc and tubes are moved toward one another.

13. A method of producing generally spherical balls which comprises: forming a multiplicity of non-spherical blanks, placing a multiplicity of said blanks in a generally vertical tube positioned eccentrically above a grinding disc having a generally horizontal plane abrasive upper surface which forms a bottom of said tube, said blanks partially filling said tube to a depth many times the cross sectional dimension of said blanks, and rotating said disc to grind and tumble said blanks in said tube and to produce circulation of said blanks in said tube continually to bring different blanks into contact with said abrasive upper surface of said disc, whereby said blanks are ground to substantially spherical shape and are reduced to predetermined diameter.

14. A method according to claim 13, further comprising delivering fluid into said tube during rotation of said disc to provide cooling and to promote circulation of said blanks in said tube and inhibit sticking of blanks to the side wall of said tube.

15. A method according to claim 14, in which said fluid is delivered primarily on the inner wall of said tube at that side of the tube toward the inner wall of which said disc rotates.

16. A method according to claim 14, in which said fluid is a grinding liquid.

17. A method according to claim 13, in which the speed of rotation of said disc is varied during the grinding of said multiplicity of blanks.

18. A method according to claim 17, in which the speed of rotation of said disc is decreased when said blanks have been ground to a shape approaching spherical.

19. A method according to claim 13, in which said blanks are formed by cutting successive sections from a wire to form generally cylindrical blanks having a length approximately equal to their diameter.

20. A method according to claim 19, in which said wire is of hardenable material and in which said blanks are hardened after being cut from said blank and before being placed in said tube for grinding.

21. A method according to claim 13, in which said blanks are of hard frangible material.

22. A method according to claim 13, in which said blanks are formed generally cubical.

* * * * *